United States Patent [19]

Gettleman

[11] Patent Number: 4,712,313

[45] Date of Patent: Dec. 15, 1987

[54] HANDS FREE PORTABLE HAIR DRYER HOLDER

[76] Inventor: Carl Gettleman, 68-85 218th St., Bayside, N.Y. 11364

[21] Appl. No.: 847,664

[22] Filed: Apr. 3, 1986

[51] Int. Cl.[4] ..... A45B 20/14

[52] U.S. Cl. ..... 34/97; 34/229; 34/239; 248/205.2; 248/284; 248/314

[58] Field of Search ..... 34/96, 97, 222, 229, 34/239; 248/205.2, 284, 314

[56] References Cited

U.S. PATENT DOCUMENTS

| | | | |
|---|---|---|---|
| 989,137 | 4/1911 | Falchi | 34/222 |
| 2,013,572 | 9/1935 | McCord | 34/96 |
| 2,678,376 | 5/1954 | Lockwood | 34/96 |
| 2,817,000 | 12/1957 | Scheid | 34/96 |
| 2,834,866 | 5/1958 | Bentlman | 34/99 |
| 2,856,700 | 10/1958 | Wales | 34/97 |
| 3,041,034 | 6/1962 | Wilkinson | 248/284 |
| 3,041,060 | 6/1962 | Jacobsen | 248/284 |
| 3,836,750 | 9/1974 | Caruso | 34/96 |
| 4,225,106 | 9/1980 | Eplan | 219/370 |

*Primary Examiner*—Albert J. Makay
*Assistant Examiner*—David W. Westphal
*Attorney, Agent, or Firm*—Richard L. Miller

[57] ABSTRACT

A hands free portable hair dryer holder is provided and is designed to hold a portable hair dryer while in use, allowing a person to use their two free hands on the hair. A mechanism can be built within the holder which will automatically swing the hair dryer up and down while in use so as to prevent excessive heat at one spot on the hair.

5 Claims, 4 Drawing Figures

HANDS FREE PORTABLE HAIR DRYER HOLDER

BACKGROUND OF THE INVENTION

The instant invention relates generally to holding devices and more specifically it relates to a hands free portable hair dryer holder.

Numerous holding devices (such as U.S. Pat. Nos. Scheid—2,817,000; Bentzman—2,834,866; and Eplan—4,225,106) have been provided in prior art that are adapted to support and secure various types of structures, such as lamps, and the like. While these prior art units may be suitable for the particular purpose to which they address, they would not be as suitable for the purpose of the present invention as heretofore described.

SUMMARY OF THE INVENTION

A primary object of the present invention is to provide a hands free portable hair dryer holder that will overcome the shortcomings of the prior art devices.

Another object is to provide a hands free portable hair dryer holder that is designed to hold a portable hair dryer while in use, allowing a person to use their two free hands on the hair.

An additional object is to provide a hands free portable hair dryer holder that includes a mechanism which automatically swings the hair dryer up and down while in use so as to prevent excessive heat at one spot on the hair.

A further object is to provide a hands free portable hair dryer holder that is simple and easy to use.

A still further object is to provide a hands free portable hair dryer holder that is economical in cost to manufacture.

Further objects of the invention will appear as the description proceeds.

To the accomplishment of the above and related objects, this invention may be embodied in the form illustrated in the accompanying drawings, attention being called to the fact, however, that the drawings are illustrative only and that changes may be made in the specific construction illustrated and described within the scope of the appended claims.

BRIEF DESCRIPTION OF THE DRAWING FIGURES

The figures in the drawings are briefly described as follows.

DETAILED DESCRIPTION OF THE PREFERRED EMBODIMENTS

Figure 2:
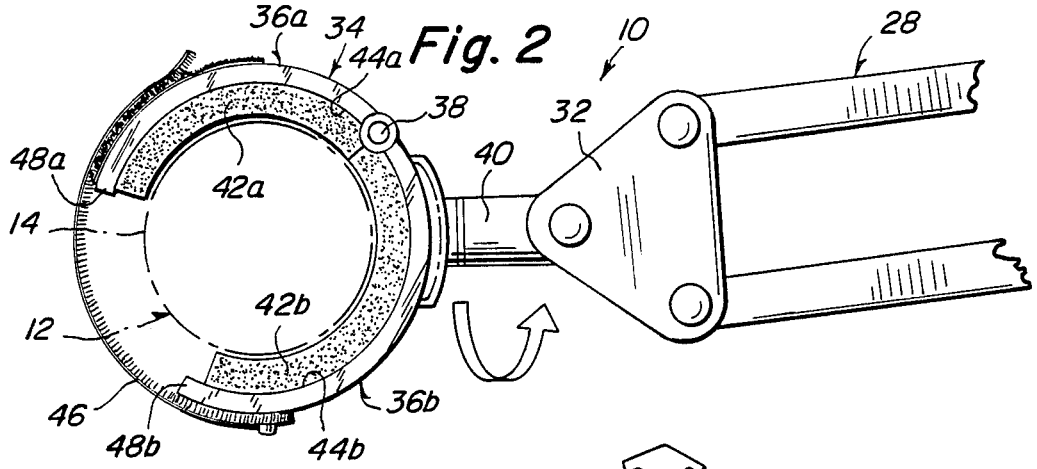
FIG. 2 is an enlarged end view of the clamp of the instant invention for grasping the hair dryer.
Figure 1:
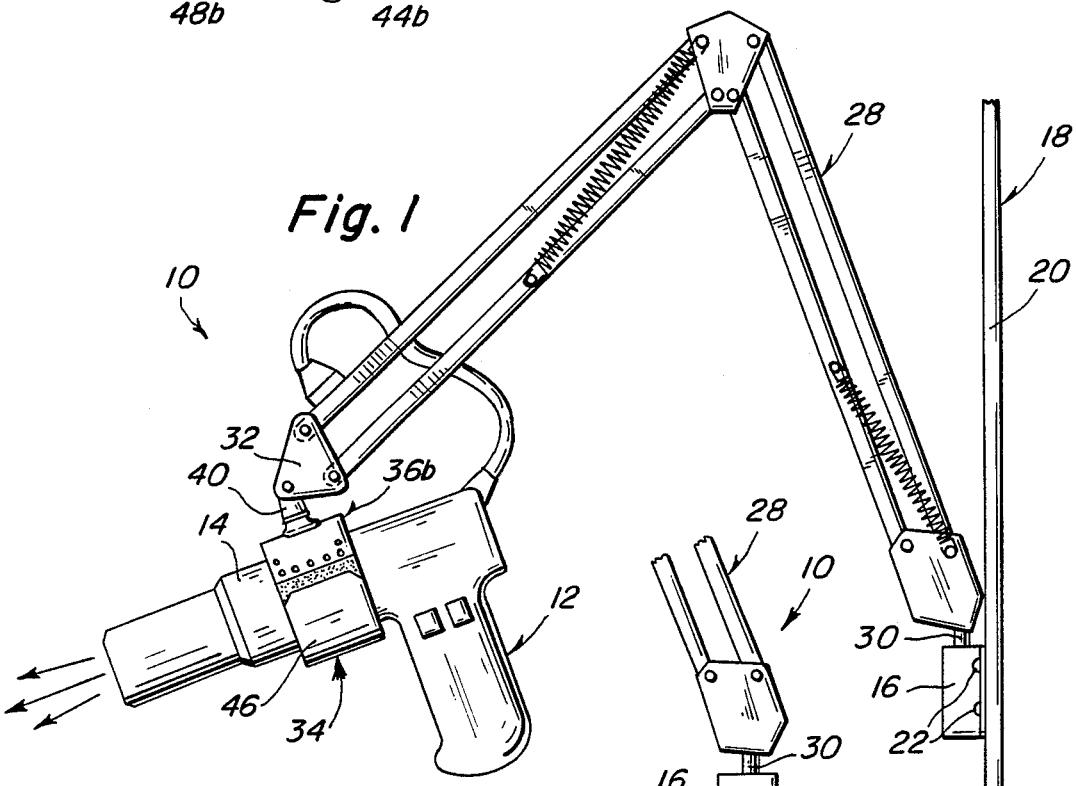
FIG. 1 is a side elevational view of the invention shown mounted on a wall, and supporting a hair dryer.
Figure 3:
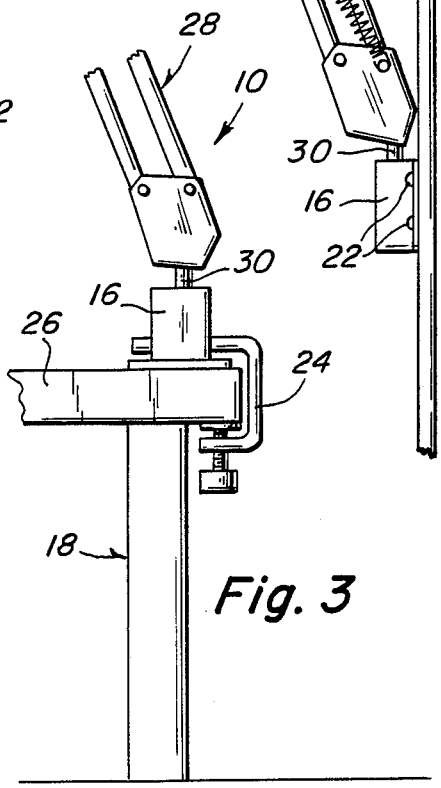
FIG. 3 is a fragmentary side elevational view of a modified form of the invention for being mounted on an edge of a table.
Figure 4:
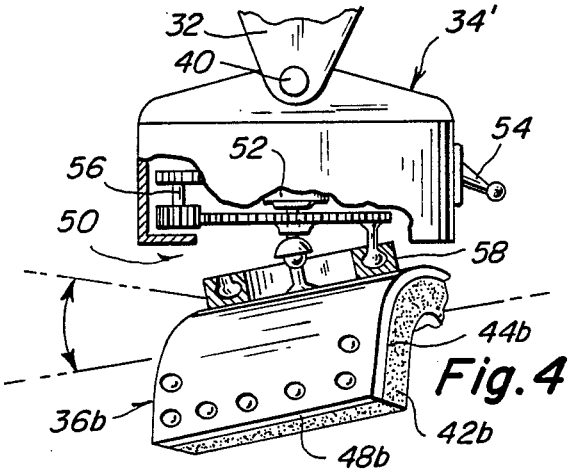
FIG. 4 is a greatly enlarged fragmentary side view of a modification of the clamp for holding the hair dryer which includes a mechanism for oscillating the hair dryer so it does not direct the hot air on one spot.

Turning now descriptively to the drawings, in which similar reference characters denote similar elements throughout the several views, FIGS. 1 through 3 illustrate a holder for a portable hair dryer 12 that has a barrel 14. The holder 10 contains a base member 16 affixed to a stationary structure 18. FIG. 1 shows the stationary structure to be a vertical wall 20 and the base member 16 affixed thereto by screws 22. In FIG. 3 a C-shaped clamp member 24 extends from the base member 16 so that the base member can be secured to a horizontal stationary structure such as a table 26.

A spring-tensioned extendable arm 28 is pivotally mounted at one end 30 to the base member 16. The extendable arm 28 has a terminal segment 32 at the other end in which a clamp assembly 34 is adjustably attached to. The clamp assembly 34 is adapted to grasp the barrel 14 of the portable hair dryer 12 and to be manually turned on its axis 360 degrees allowing the hair dryer to be placed in a variety of positions. A person (not shown) using the holder 10 is free to use their two hands for other things.

The clamp assembly 34 consists of two C-shaped jaws **36*a*, 36*b* hinged together at 38. One of the jaws 36*b* is adjustably attached at 40 to the terminal segment 32 of the adjustable arm 28. Two C-shaped foam liners 42*a*, 42*b* are also provided. Linear 42*a* is affixed to inner wall 44*a* of the jaws 36*a*, while liner 42*b* is affixed to inner wall 44*b* of the jaw 36*b* for cushioning the barrel 14 of the portable hair dryer 12. A hook and loop pile fastener strip 46 extends between free ends 48*a*, 48*b* of the jaws 36*a*, 36*b* for securing the jaws in a closed position around the barrel 14 of the portable hair dryer 12**.

FIG. 5 shows a modified clamp assembly 34' comprising an apparatus 50 for oscillating the portable hair dryer 12 so it does not direct hot air on one spot of the hair (not shown). The apparatus 50 includes an electric motor 52, a switch 54 to turn the motor on and off, a gear train 56 operated by the motor 52 and a cam mechanism 58 controlled the gear train 56 which will automatically swing the portable hair dryer 12 up and down while in use.

While certain novel features of this invention have been shown and described and are pointed out in the annexed claims, it will be understood that various omissions, substitutions and changes in the forms and details of the device illustrated and in its operation can be made by those skilled in the art without departing from the spirit of the invention.

What is claimed is:

1. A holder for a standard, separable portable hair dryer having a barrel comprising:

(a) a base member affixed to a stationary structure;

(b) a spring-tensioned extendable arm pivotally mounted at one end of said base member, said extendable arm having a terminal segment at other end; and (c) a clamp assembly adjustably attached to terminal segment of said extendable arm, said clamp assembly adapted to removably grasp said barrel of said portable hair dryer and to be manually turned on its axis 360 degrees allowing said hair dryer to be placed in a variety of positions in which a person using said holder is free to use their two hands for other things wherein said clamp assembly comprises:

(i) two C-shaped jaws hinged together, one of said jaws being adjustably attached to said terminal segment of said adjustable arm;

(ii) two C-shaped foam liners, each of which is affixed to an inner wall of one of said jaws for cushioning said barrel of said portable hair dryer; and (iii) a hook and loop pile fastener strap extending between free ends of said jaws for securing said jaws in a closed position around said barrel of said portable hair dryer.

2. A holder as recited in claim 1 wherein said stationary structure is a vertical wall and said base member is affixed thereto by a plurality of screws.

3. A holder as recited in claim 1 wherein said base member includes a C-shaped clamp member extending therefrom so that said base member can be secured to a horizontal stationary structure such as a table.

4. A holder as recited in claim 1 wherein said clamp assembly further comprises a means for oscillating said portable hair dryer so it does not direct hot air on one spot of the hair.

5. A holder as recited in claim 4 wherein said oscillating means includes an electric motor, a switch to turn said motor on and off, a gear train operated by said motor and a cam mechanism controlled by said gear train which will automatically swing said portable hair dryer up and down while in use.

* * * * *